US009847596B2

(12) United States Patent
Sato

(10) Patent No.: US 9,847,596 B2
(45) Date of Patent: Dec. 19, 2017

(54) TERMINAL FITTING AND METHOD OF MANUFACTURING WIRE WITH TERMINAL

(71) Applicant: Yazaki Corporation, Minato-ku, Tokyo (JP)

(72) Inventor: Kei Sato, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 14/857,318

(22) Filed: Sep. 17, 2015

(65) Prior Publication Data

US 2016/0006164 A1 Jan. 7, 2016

Related U.S. Application Data

(63) Continuation of application No. PCT/JP2014/056880, filed on Mar. 14, 2014.

(30) Foreign Application Priority Data

Mar. 19, 2013 (JP) ..... 2013-057230

(51) Int. Cl.
*H01R 4/18* (2006.01)
*H01R 4/20* (2006.01)
(Continued)

(52) U.S. Cl.
CPC ..... *H01R 13/5216* (2013.01); *H01R 4/184* (2013.01); *H01R 4/185* (2013.01);
(Continued)

(58) Field of Classification Search
CPC . H01R 4/18; H01R 4/20; H01R 4/188; H01R 4/203; H01R 4/206
(Continued)

(56) References Cited

U.S. PATENT DOCUMENTS 7,828,611 B2 * 11/2010 Nakamura ..... H01R 4/185 439/877
8,974,258 B2 * 3/2015 Mitose ..... H01R 4/184 439/877
(Continued)

FOREIGN PATENT DOCUMENTS

CN 101645543 A 2/2010
CN 102859795 A 1/2013
(Continued)

OTHER PUBLICATIONS

International Search Report for PCT/JP2014/056880 dated Jun. 10, 2014.
(Continued)

*Primary Examiner* — Edwin A. Leon
*Assistant Examiner* — Paul Baillargeon
(74) *Attorney, Agent, or Firm* — Sughrue Mion, PLLC

(57) ABSTRACT

A wire connection part of a terminal fitting includes: a barrel piece which is caulked while covering a tip end of a wire, thereby being crimped to the wire; a serration part formed on an inner surface of the barrel piece and connected to a core of the wire; and a water stop part mounted on the inner surface of the barrel piece to close a gap with the wire. A projecting piece mounted anterior to the serration part to position a tip end of the core is mounted to the barrel piece. The tip end of the core is positioned by the projecting piece, whereby the positional deviation of the wire can be prevented.

8 Claims, 11 Drawing Sheets

(51) Int. Cl.

| | |
|---|---|
| ***H01R 13/52*** | (2006.01) |
| ***H01R 4/70*** | (2006.01) |
| ***H01R 43/00*** | (2006.01) |
| ***H01R 43/16*** | (2006.01) |
| *H01R 4/62* | (2006.01) |

(52) U.S. Cl.
CPC ..... *H01R 4/70* (2013.01); *H01R 43/005* (2013.01); *H01R 43/16* (2013.01); *H01R 4/188* (2013.01); *H01R 4/203* (2013.01); *H01R 4/62* (2013.01); *H01R 13/52* (2013.01); *H01R 2201/26* (2013.01)

(58) Field of Classification Search
USPC ..... 439/741, 877, 519, 604, 587, 948
See application file for complete search history.

(56) References Cited

U.S. PATENT DOCUMENTS

| | | | |
|---|---|---|---|
| 2010/0035482 | A1 | 2/2010 | Nakamura et al. |
| 2010/0035486 | A1 | 2/2010 | Tabata et al. |
| 2013/0095708 | A1 | 4/2013 | Mitose et al. |

FOREIGN PATENT DOCUMENTS

| | | | |
|---|---|---|---|
| EP | 2555328 | A1 | 2/2013 |
| JP | 55-007234 | U | 1/1980 |
| JP | 59-10696 | Y2 | 4/1984 |
| JP | 2007-12341 | A | 1/2007 |
| JP | 2009-176537 | A | 8/2009 |
| JP | 2011103220 | A | 5/2011 |
| JP | 2012069449 | A | 4/2012 |
| WO | 2011/122622 | A1 | 10/2011 |

OTHER PUBLICATIONS

Communication dated Aug. 16, 2016, from the State Intellectual Property Office of the P.R.C., in counterpart Chinese application No. 201480016534.1.

German Office Action; Application No. 112014001526.1; dated Nov. 11, 2016.

Japanese Office Action; Application No. 2013-057230; dated Jul. 14, 2016.

Communication dated Feb. 23, 2017 issued by the State Intellectual Property Office of the People's Republic of China in counterpart Chinese application No. 201480016534.1.

* cited by examiner

TERMINAL FITTING AND METHOD OF MANUFACTURING WIRE WITH TERMINAL

CROSS-REFERENCE TO RELATED APPLICATION

This application is a continuation application of International Application PCT/JP2014/056880, filed on Mar. 14, 2014, and designating the U.S., the entire contents of which are incorporated herein by reference.

BACKGROUND OF THE INVENTION

1. Field of the Invention

The present invention relates to a terminal fitting included in a wire harness disposed in an automobile, and a method of manufacturing a wire with a terminal having the terminal fitting.

2. Description of the Related Art

Generally, a wire harness for transmitting electric power or a control signal is disposed between electronic devices. A wire harness includes one or more wires, a terminal fitting crimped to a terminal of each wire, and a connector storing the terminal fitting. This connector is fitted to a counterpart connector, whereby an electrical connection is established. A connector used for a wire harness of this type generally includes a tubular connector housing, herein a terminal fitting is stored in a terminal storage chamber (cavity) formed on the connector housing.

A terminal fitting is formed by, for example, bending a conductive plate, and includes a wire connection part connected to a wire, and an electric contact part connected to a terminal fitting in a counterpart connector. The wire connection part has a crimp part (barrel piece) crimped to a terminal of a wire with caulking, and a saw-like serration part is formed on an inner surface of the crimp part for holding a core of a wire to ensure electrical connection. There is also proposed a terminal structure in which a water stop member is provided on an inner surface of a crimp part of a wire connection part in order to close a gap with a wire to prevent water from entering a core and a serration part (see, for example, WO 2011/122622 A1).

As illustrated in FIGS. 15, 16A, 16B, 16C, 16D, and 16E, a crimp terminal 100 described in Patent Literature 1 is a female terminal connected to a counterpart male terminal, and includes an electric contact part 101 in a rectangular cylindrical shape, a wire connection part 102 mounted at the back of the electric contact part 101 and connected to a wire W, and a coupling part 103 with a cross-section of a reversed C shape, the coupling part 103 coupling these parts. As illustrated in FIGS. 16A, 16B, and 16C, the wire connection part 102 has a barrel piece 104 with a cross-section of an almost U shape which is open to one side before it is caulked (before crimped), and a saw-like serration part 105 for holding a core W1 of the wire W is formed on an inner surface of the barrel piece 104. The barrel piece 104 also has a sheet-type holding part 106 extending backward from the serration part 105. This holding part 106 holds an insulating coating W2 of the wire W.

The barrel piece 104 of the crimp terminal 100 is also provided with a water stop member 107 formed continuously along edges of four sides on its inner surface, and a water stop member 108 formed along an edge of an opening on one outer surface. As illustrated in FIGS. 16D and 16E, in the state in which the barrel piece 104 is caulked to be crimped to the wire W, the opening edges of the barrel piece 104 are overlapped to cover the wire W, the inner water stop member 107 is in close contact with the insulating coating W2 of the wire W, and the water stop members 107 and 108 are in close contact with each other at the overlapping part. In addition, the barrel piece 104 is crushed with the coupling part 103 by caulking at the front part of the wire connection part 102, whereby the inner water stop member 107 closes the gap between edges of the barrel piece 104. Thus, the connection part between the core W1 of the wire W and the serration part 105 is waterproofed.

However, in the conventional terminal fitting described in WO 2011/122622 A1, the barrel piece 104 is crushed with the coupling part 103 by caulking at the front part of the wire connection part 102, so that the core W1 of the wire W is surrounded by the barrel piece 104. Therefore, as the position of the tip end of the core W1 cannot be confirmed, positioning precision for the wire W in a crimping process is required. This might cause various troubles. For example, labor and time for the crimping process increases, causing deteriorated efficiency; a connection failure occurs between the core W1, that is shifted backward, and the serration part 105; or the caulking resistance increases due to the core W1 shifted forward.

SUMMARY OF THE INVENTION

The present invention is accomplished in view of the above circumstances, and aims to provide a terminal fitting and a method of manufacturing a wire with a terminal, which can enhance working efficiency in a crimping process as well as prevent failure in connection with a wire.

In order to solve the above-mentioned problems, a terminal fitting according to one aspect of the present invention includes an electric contact part connected to a counterpart terminal from front; and a wire connection part connected to a wire at a back of the electric contact part. Herein, the wire connection part includes a barrel piece which is caulked while covering a tip end of the wire, thereby being crimped to the wire; a serration part formed on an inner surface of the barrel piece and connected to a core of the wire; and a water stop part mounted on the inner surface of the barrel piece to close a gap with the wire. A positioning unit mounted anterior to the serration part to position a tip end of the core is mounted to at least one of the barrel piece and the water stop part.

Further, in the terminal fitting according to another aspect of the present invention, the positioning unit is formed such that a projecting piece projecting forward at a circumferential end of the barrel piece or the water stop part is deformed toward the core by caulking, or the positioning unit is formed such that a front end of the barrel piece is deformed toward the core by caulking.

In order to solve the above-mentioned problems, a manufacturing method according to still another aspect of the present invention for manufacturing a wire with a terminal is the manufacturing method for manufacturing the wire with the terminal by crimping the above-mentioned terminal fitting the wire. The method includes applying a liquid water stop material onto an inner surface of the barrel piece to form the water stop part, or attaching a sheet-type water stop material to the inner surface of the barrel piece to form the water stop part; and deforming the barrel piece into a cylinder by caulking to cover the tip end of the wire as well as to cause the water stop part to be in close contact with the wire.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
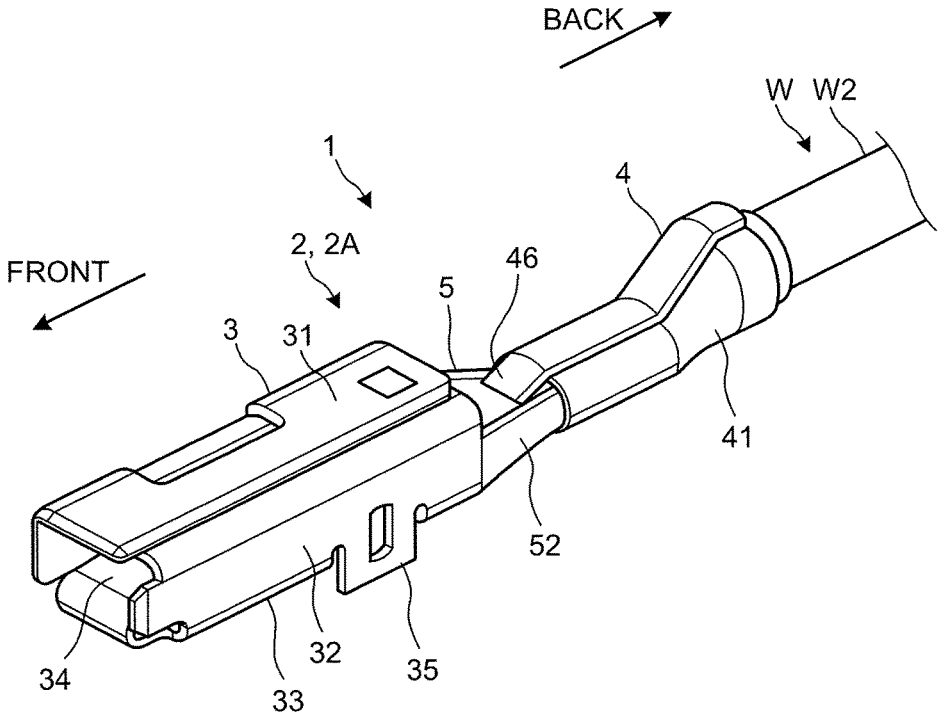
FIG. 1 is a perspective view illustrating a wire with a terminal according to a first embodiment of the present invention.

A wire with a terminal according to embodiments of the present invention will be described below with reference to FIGS. 1 to 14. A wire with a terminal 1 according to the present embodiment forms a wire harness disposed in an automobile, and is fitted and connected to various types of electronic devices mounted to an automobile and the like or to a counterpart connector mounted to another wire harness. The wire harness includes one or more wires W, a terminal fitting 2 crimped to a terminal of the wire W, and a connector, not illustrated, for storing the terminal fitting 2. The wire W includes a conductive core W1, and an insulating coating W2 coating the core W1. The insulating coating W2 at its end is peeled to expose the core W1, and the exposed core W1 is electrically and mechanically connected to the terminal fitting 2.

The terminal fitting 2 (2A, 2B, and 2C) is a female terminal fitting formed by a punching process and a bending process to a conductive plate. The terminal fitting 2 includes an electric contact part 3 in a rectangular cylindrical shape connected to a counterpart terminal (male terminal) from front (from left in FIG. 1), a wire connection part 4 mounted at the back of the electric contact part 3 and connected to the wire W, and a coupling part 5 coupling these parts, the coupling part 5 having a cross-section of a reversed C shape. Here, the front of the terminal fitting 2 (2A, 2B, 2C) typically corresponds to the side where the counterpart terminal is located when the terminal fitting 2 is connected to the counterpart terminal. In other words, the front of the terminal fitting 2 corresponds to a tip end side of the core W1 exposed from the insulating coating W2 in the extending direction of the wire W (see FIG. 1). On the other hand, the back of the terminal fitting 2 (2A, 2B, 2C) typically corresponds to the side opposite to the side where the counterpart terminal is located when the terminal fitting 2 is connected to the counterpart terminal. In other words, the back of the terminal fitting 2 corresponds to a base end side of the core W1 exposed from the insulating coating W2 in the extending direction of the wire W (see FIG. 1).

The electric contact part 3 is formed into a rectangular cylinder having an upper wall part 31, a pair of side walls 32, and a bottom wall 33, and is continuously formed with a bottom plate 51 and a pair of side plates 52 of the coupling part 5. A counterpart terminal is inserted into the electric contact part 3 of the terminal fitting 2 (2A, 2B, 2C), and an elastic piece 34 holding the counterpart terminal with an inner surface of the electric contact part 3 is formed in the electric contact part 3. The terminal fitting 2 (2A, 2B, 2C) holds the counterpart terminal between the inner surface of the electric contact part 3 and the elastic piece 34 as described above, whereby the terminal fitting 2 and the counterpart terminal are electrically and mechanically connected to each other. The electric contact part 3 of the terminal fitting 2 (2A, 2B, 2C) is provided with a stabilizer 35 projecting from one side (or two sides) of the side walls 32. The stabilizer 35 is inserted into a guide groove in a connector housing (not illustrated) to be guided, whereby the terminal fitting 2 can be inserted into the connector housing in a predetermined direction.

Figure 2:
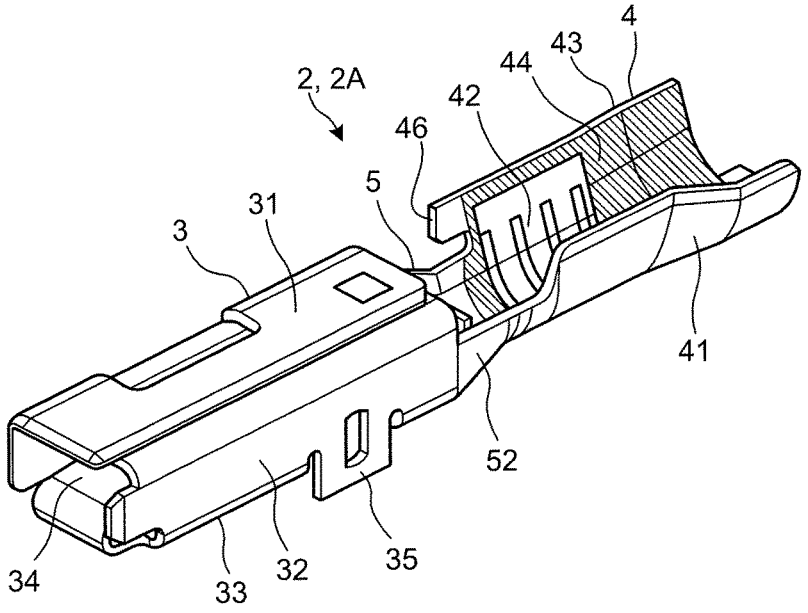
FIG. 2 is a perspective view illustrating a terminal fitting used for the wire with a terminal according to the first embodiment of the present invention.

The wire connection part 4 has a barrel piece 41 continuous with the bottom plate 51 and the pair of side plates 52 of the coupling part 5. The barrel piece 41 has a cross-section of an almost U shape open to one side (open upward in the figure) before it is caulked (before it is crimped as illustrated in FIG. 2 or the like). The barrel piece 104 is caulked while covering a tip end of the wire W, thereby being crimped to the wire W. A saw-like serration part 42 for holding the core W1 of the wire W is formed on an inner surface of the barrel piece 41 of the terminal fitting 2 (2A, 2B, 2C). The barrel piece 41 also has a sheet-type holding part 43 extending posterior to the serration part 42. The holding part 43 is configured to hold the insulating coating W2 of the wire W.

A water stop part 44 for closing a gap with the wire W is formed on the inner surface of the barrel piece 41 of the terminal fitting 2 (2A, 2B, 2C) except for the serration part 42. The terminal fitting 2 (2A, 2B, 2C) is also provided with a front water stop part 45 for closing the inside of the barrel piece 41 that is deformed into a cylinder, the front water stop part 45 being mounted anterior to the core W1 of the wire W in the state in which the barrel piece 41 is caulked. The front water stop part 45 may be formed such that the water stop part 44 projects forward by the caulking of the barrel piece 41, or may be formed by filling a water stop material after the caulking of the barrel piece 41.

First Embodiment

Figure 3A:
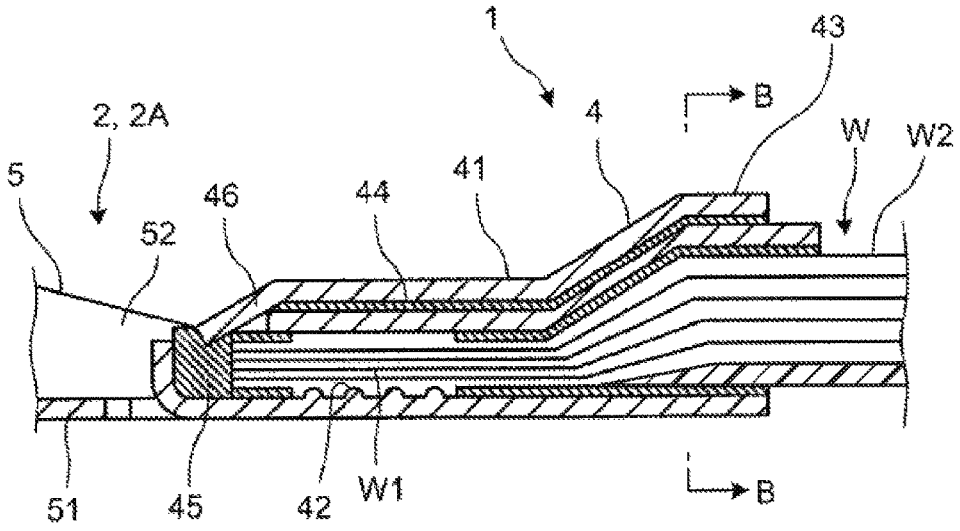
FIG. 3A is a sectional view illustrating the wire with a terminal according to the first embodiment of the present invention.
Figure 3B:
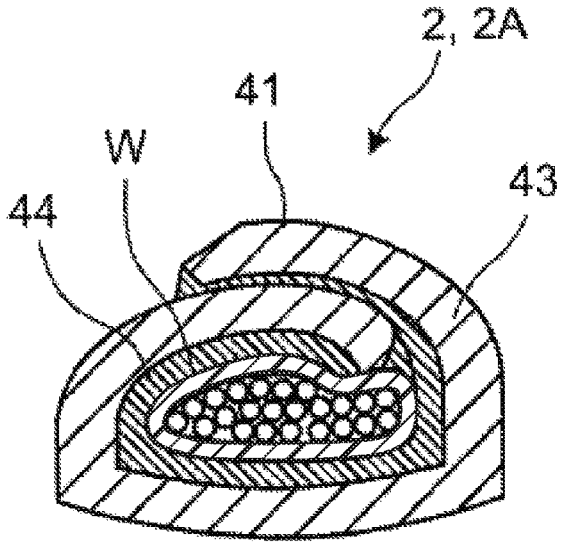
FIG. 3B is a sectional view along a line B-B in FIG. 3A.
Figure 4:
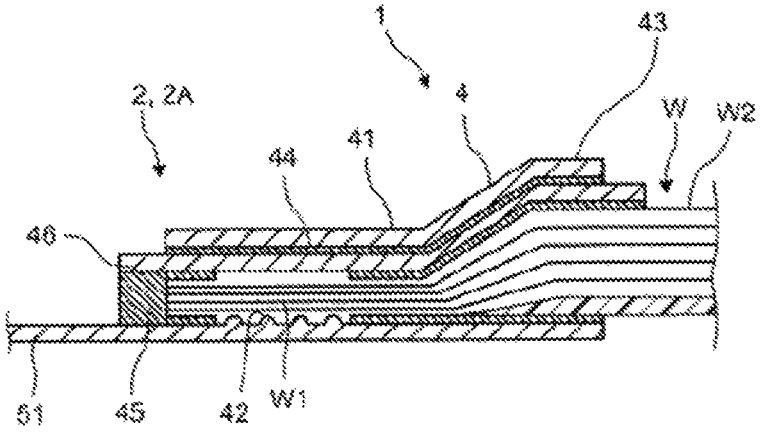
FIG. 4 is a sectional view illustrating a modification of the wire with a terminal according to the first embodiment of the present invention.

Next, the terminal fitting 2A according to a first embodiment will be described in detail with reference to FIGS. 1 to 5. The wire connection part 4 in the terminal fitting 2A is provided with a projecting piece 46 projecting forward (toward the electric contact part 3) from the vicinity of one edge of the U-shaped barrel piece 41 as illustrated in FIG. 2. As illustrated in FIGS. 1 and 3, the projecting piece 46 is caulked simultaneous with the caulking of the barrel piece 41 or after the barrel piece 41 is caulked. The projecting piece 46 is thus deformed toward the core W1 of the wire W to be in contact with the tip end of the core W1. More specifically, the projecting piece 46 has a function as a positioning unit to position the wire W in the longitudinal direction by contacting to the tip end of the core W1. In other words, the positioning unit is formed by deforming the projecting piece 46, which projects forward at the circumferential end of the barrel piece 41, toward the core W1 by caulking. The projecting piece 46 is formed anterior to the serration part 42 for positioning the tip end of the core W1. The projecting piece 46 is not limited to the one deformed toward the core W1. The projecting piece 46 may be formed to extend forward from the tip end of the core W1 in such a manner that its inner surface is in contact with the tip end of the core W1 as illustrated in FIG. 4.

Figure 5:
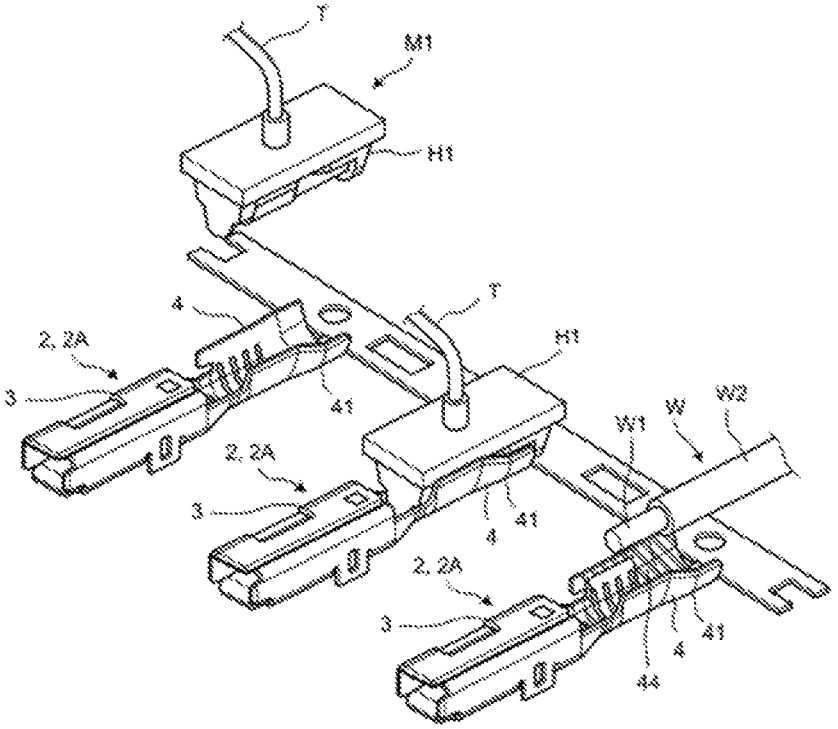
FIG. 5 is a perspective view illustrating a manufacturing procedure of the wire with a terminal according to the first embodiment of the present invention.

A manufacturing procedure of the wire with a terminal 1 as described above will now be described. As illustrated in FIG. 5, a water stop material applying process, a wire set process, and a barrel piece caulking process are sequentially performed in this order to a plurality of terminal fittings 2A, which are formed by performing a punching process and a bending process to a plate and are connected in a chain, and which are carried from an upstream side (left in FIG. 5) to a downstream side (right in FIG. 5). The water stop material applying process is performed by using a water stop material applying device M1 having an application head H1 that applies a water stop material onto an inner surface of the barrel piece 41. The water stop material applying device M1 lowers the application head H1 toward the inner surface of the barrel piece 41, and then, supplies a water stop material to the application head H1 through a tube T. Thus, the water stop material applying device M1 applies the water stop material onto the inner surface of the barrel piece 41, whereby the water stop part 44 is formed. Appropriate materials such as butyl rubber, silicon rubber, epoxy resin, or urethane resin can be used as the water stop material to be applied. More specifically, a liquid water stop material is applied on the inner surface of the barrel piece 41 to form the water stop part 44.

After the water stop part 44 is formed on the inner surface of the barrel piece 41 as described above, a wire supply device (not illustrated) sets the tip end of the wire W in the barrel piece 41. Subsequently, a crimp device (not illustrated) caulks the barrel piece 41 to crimp the terminal fitting 2A and the wire W. In other words, the barrel piece 41 is caulked to be deformed into a cylinder to cover the tip end of the wire W to cause the water stop part 44 to be in close contact with the wire W. Thereafter, the terminal fittings 2A in a chain are separated, whereby the wire with a terminal 1 in which the terminal fitting 2A is crimped to the terminal of the wire W is manufactured.

Second Embodiment

Figure 6:
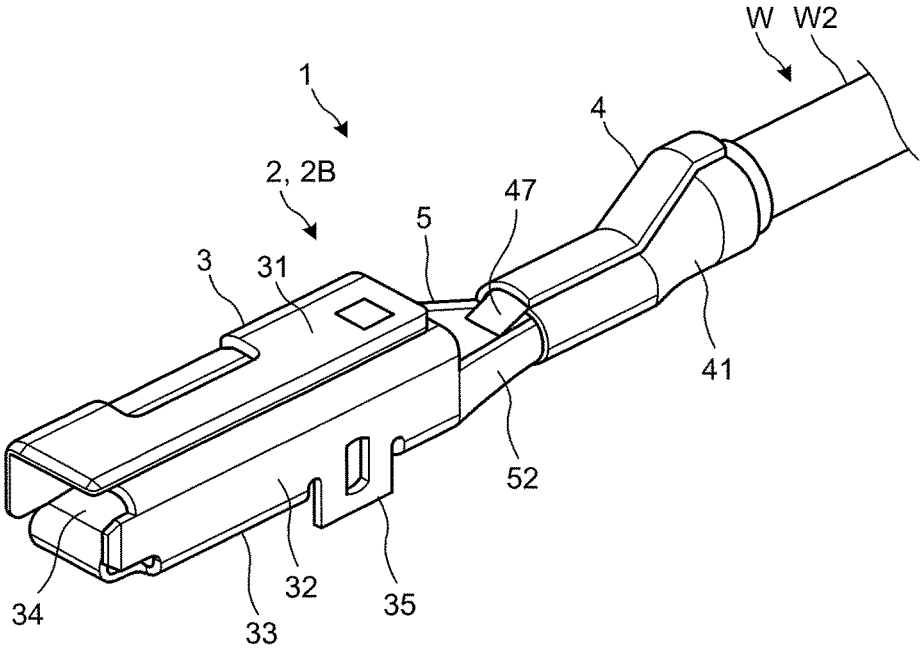
FIG. 6 is a perspective view illustrating a wire with a terminal according to a second embodiment of the present invention.
Figure 7:
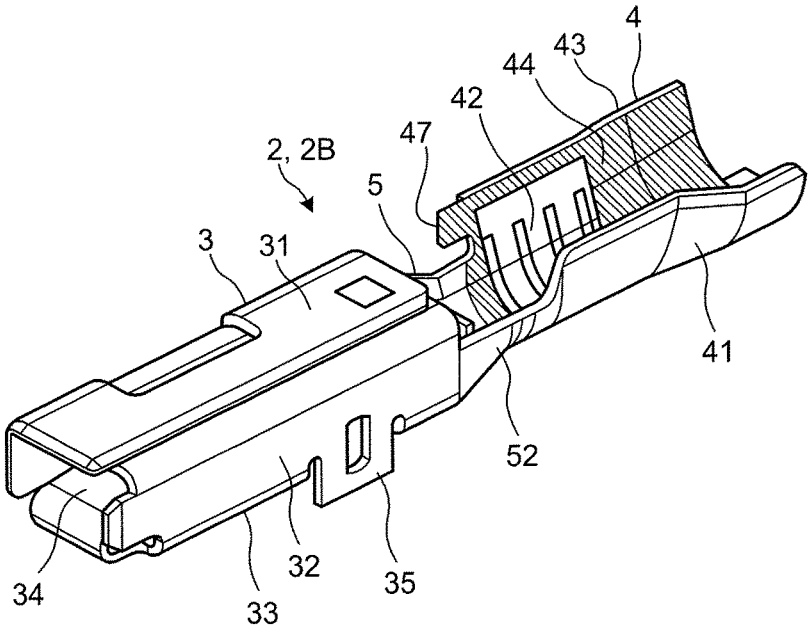
FIG. 7 is a perspective view illustrating a terminal fitting used for the wire with a terminal according to the second embodiment of the present invention.
Figure 8:
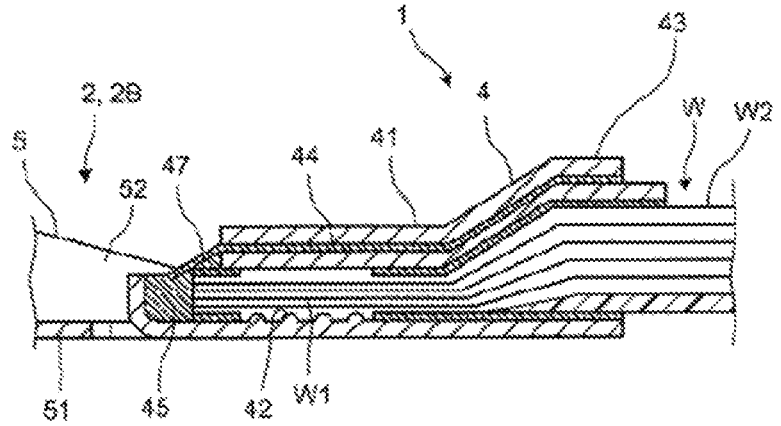
FIG. 8 is a sectional view illustrating the wire with a terminal according to the second embodiment of the present invention.

Next, a terminal fitting 2B according to a second embodiment will be described in detail with reference to FIGS. 6 to 10. A wire connection part 4 in the terminal fitting 2B is provided with a projecting piece 47 projecting forward (toward the electric contact part 3) from the vicinity of one edge of a water stop part 44 formed on a U-shaped barrel piece 41 as illustrated in FIG. 7. As illustrated in FIGS. 6 and 8, the projecting piece 47 is caulked simultaneous with the caulking of the barrel piece 41 or after the barrel piece 41 is caulked. The projecting piece 47 is thus deformed toward a core W1 of a wire W to be in contact with the tip end of the core W1. More specifically, the projecting piece 47 has a function as a positioning unit to position the wire W in the longitudinal direction by contacting to the tip end of the core W1. In other words, the positioning unit is formed by deforming the projecting piece 47, which projects forward at the circumferential end of the water stop part 44, toward the core W1 by caulking. The projecting piece 47 is formed anterior to a serration part 42 for positioning the tip end of the core W1.

Figure 9:
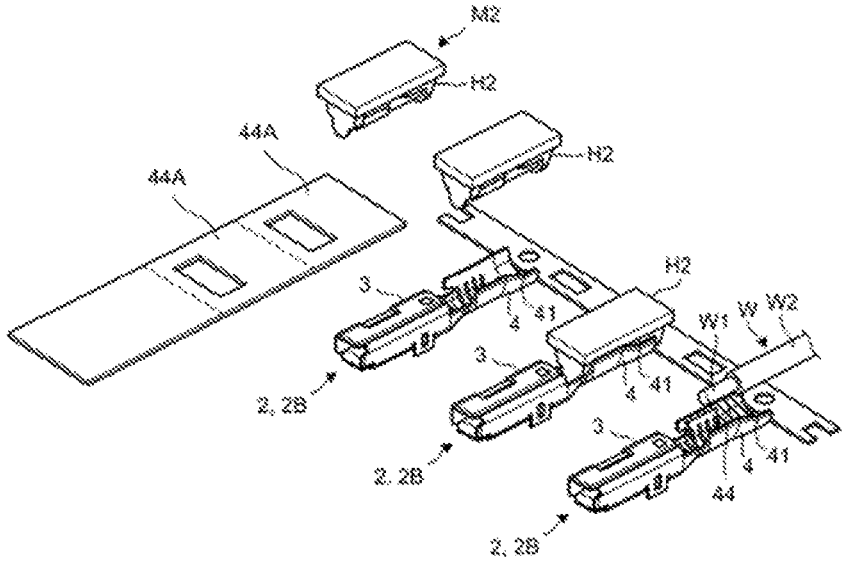
FIG. 9 is a perspective view illustrating a manufacturing procedure of the wire with a terminal according to the second embodiment of the present invention.

A manufacturing procedure of the wire with a terminal 1 as described above will now be described. As illustrated in FIG. 9, a water stop material attaching process, a wire set process, and a barrel piece caulking process are sequentially performed to a plurality of terminal fittings 2B, which are formed by performing a punching process and a bending process to a plate and are connected in a chain, and which are carried from an upstream side (left in FIG. 9) to a downstream side (right in FIG. 9). The water stop material attaching process is performed by using a water stop material attaching device M2 having an attachment head H2 for attaching a water stop sheet 44A onto the inner surface of the barrel piece 41. The water stop material attaching device M2 holds the water stop sheet 44A with the attachment head H2 by, for example, sucking, and then lowers the attachment head H2 toward the inner surface of the barrel piece 41 to press the attachment head H2 against the inner surface of the barrel piece 41. Thus, the water stop material attaching device M2 attaches the water stop sheet 44A on the inner surface of the barrel piece 41, whereby the water stop part 44 is formed. More specifically, the water stop material attaching device M2 attaches the water stop sheet 44A that is a sheet-type water stop material onto the inner surface of the barrel piece 41 to form the water stop part 44.

Figure 10A:
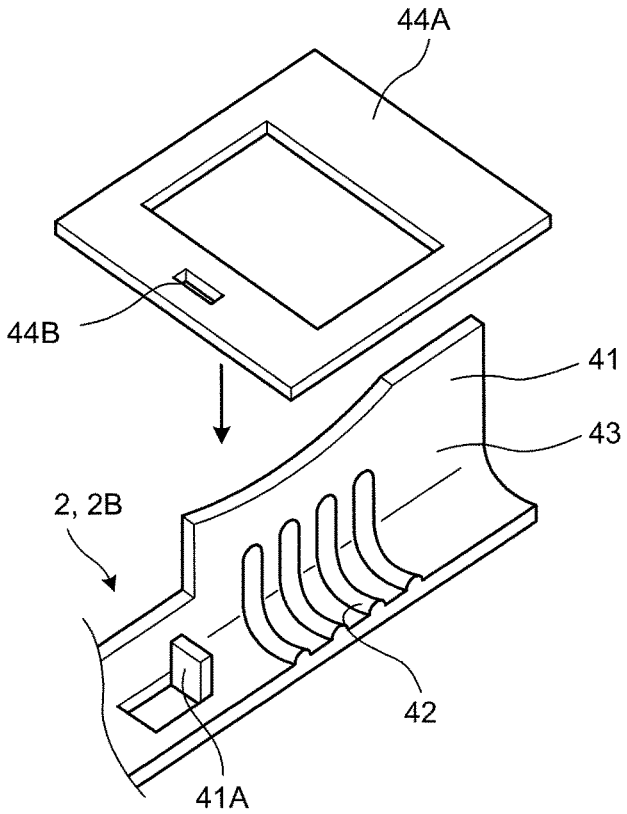
FIG. 10A is a perspective view illustrating a part of the wire with a terminal according to the second embodiment of the present invention.
Figure 10B:
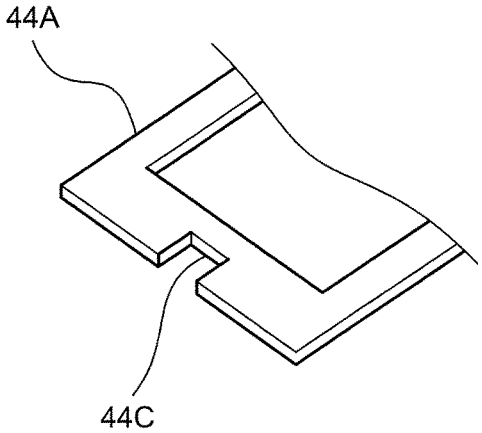
FIG. 10B is a perspective view illustrating a part of the wire with a terminal according to the second embodiment of the present invention.

An appropriate material formed into a sheet, such as butyl rubber, silicon rubber, epoxy resin, or urethane resin, can be used as the water stop sheet 44A to be attached. It is preferable that an adhesive agent is applied onto the back surface of the water stop sheet 44A facing the inner surface of the barrel piece 41. An adhesive agent may be applied on the front surface of the water stop sheet 44A facing the wire W. As illustrated in FIGS. 10A and 10B, a projection 41A may be formed on the bottom surface of the barrel piece 41, and the projection 41A may be inserted into an insertion hole 44B (FIG. 10A) formed on the water stop sheet 44A to position the water stop sheet 44A. Alternatively, the projection 41A may be inserted into a cutout 44C (FIG. 10B) formed on the water stop sheet 44A to position the water stop sheet 44A.

After the water stop part 44 is formed on the inner surface of the barrel piece 41 as described above, a wire supply device (not illustrated) sets the tip end of the wire W in the barrel piece 41. Then, a crimp device (not illustrated) caulks the barrel piece 41 to crimp the terminal fitting 2B and the wire W. In other words, the barrel piece 41 is caulked to be deformed into a cylinder to cover the tip end of the wire W to cause the water stop part 44 to be in close contact with the wire W. Thereafter, the terminal fittings 2B in a chain are separated, whereby the wire with a terminal 1 in which the terminal fitting 2B is crimped to the terminal of the wire W is manufactured.

Third Embodiment

Figure 11:
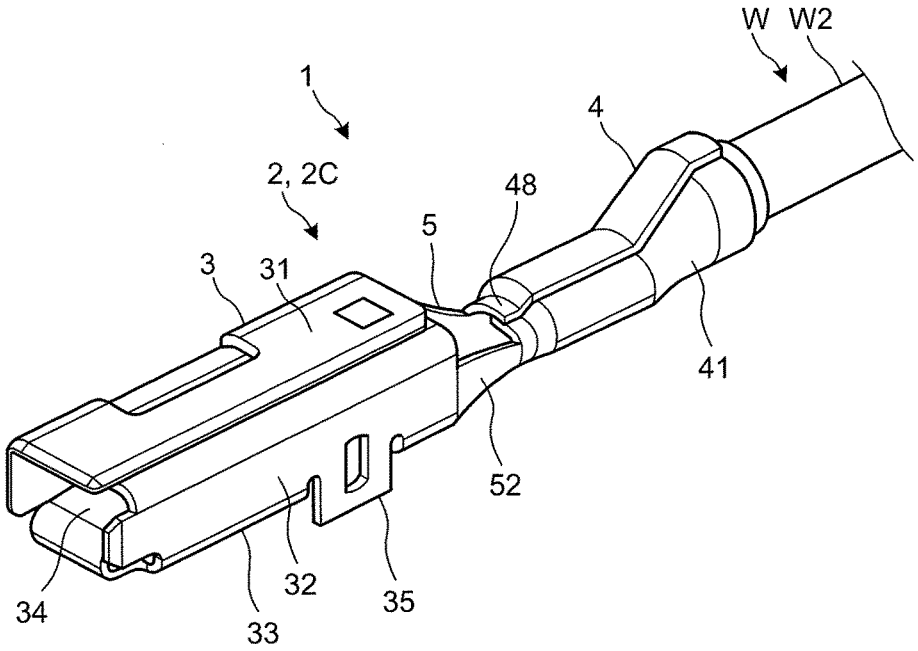
FIG. 11 is a perspective view illustrating a wire with a terminal according to a third embodiment of the present invention.
Figure 12:
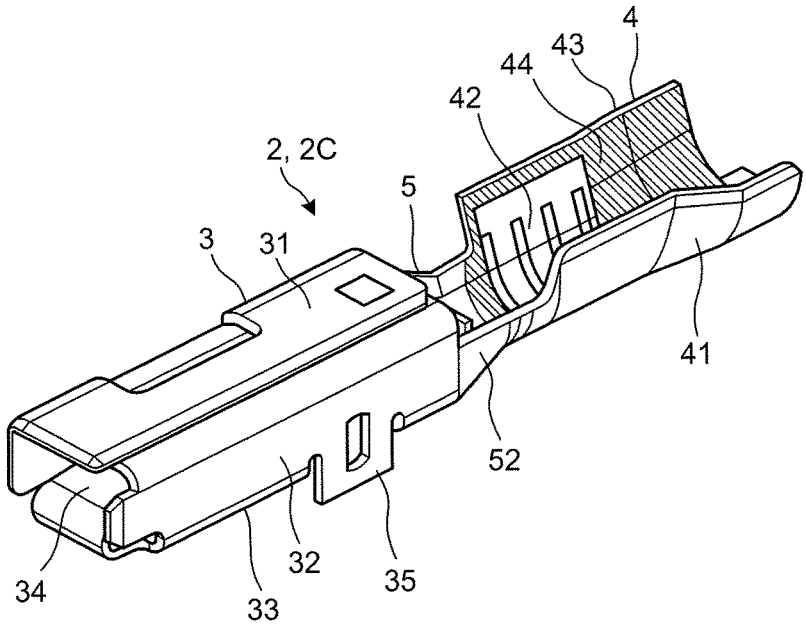
FIG. 12 is a perspective view illustrating a terminal fitting used for the wire with a terminal according to the third embodiment of the present invention.
Figure 13A:
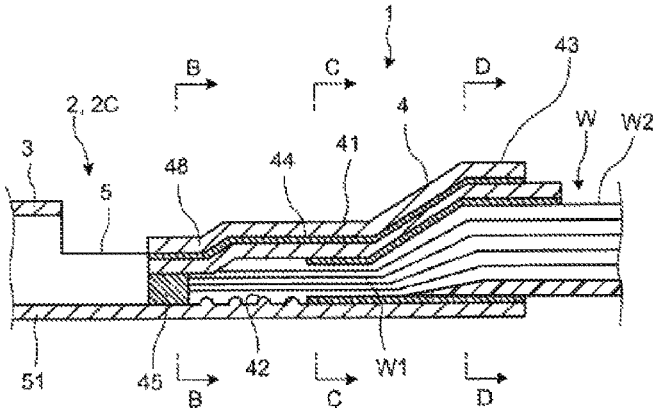
FIG. 13A is a sectional view illustrating the wire with a terminal according to the third embodiment of the present invention.
Figure 13B:
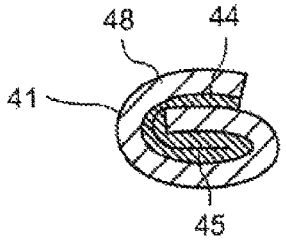
FIG. 13B is a sectional view along a line B-B in FIG. 13A.
Figure 13C:
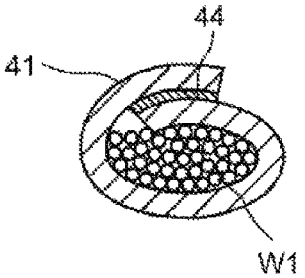
FIG. 13C is a sectional view along a line C-C in FIG. 13A.
Figure 13D:
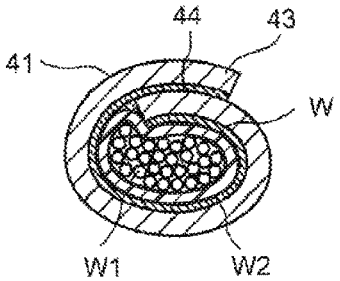
FIG. 13D is a sectional view along a line D-D in FIG. 13A.
Figure 14A:
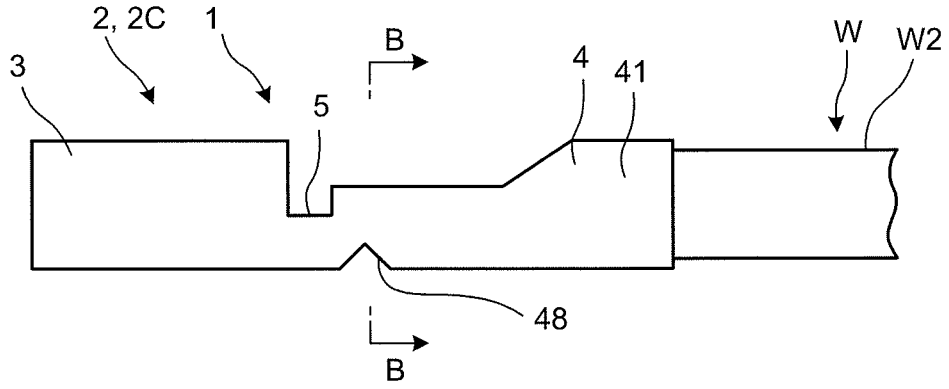
FIG. 14A is a sectional view illustrating a modification of the wire with a terminal according to the third embodiment of the present invention.
Figure 14B:
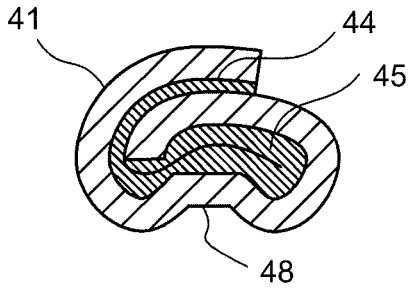
FIG. 14B is a sectional view along a line B-B in FIG. 14A.
Figure 15:
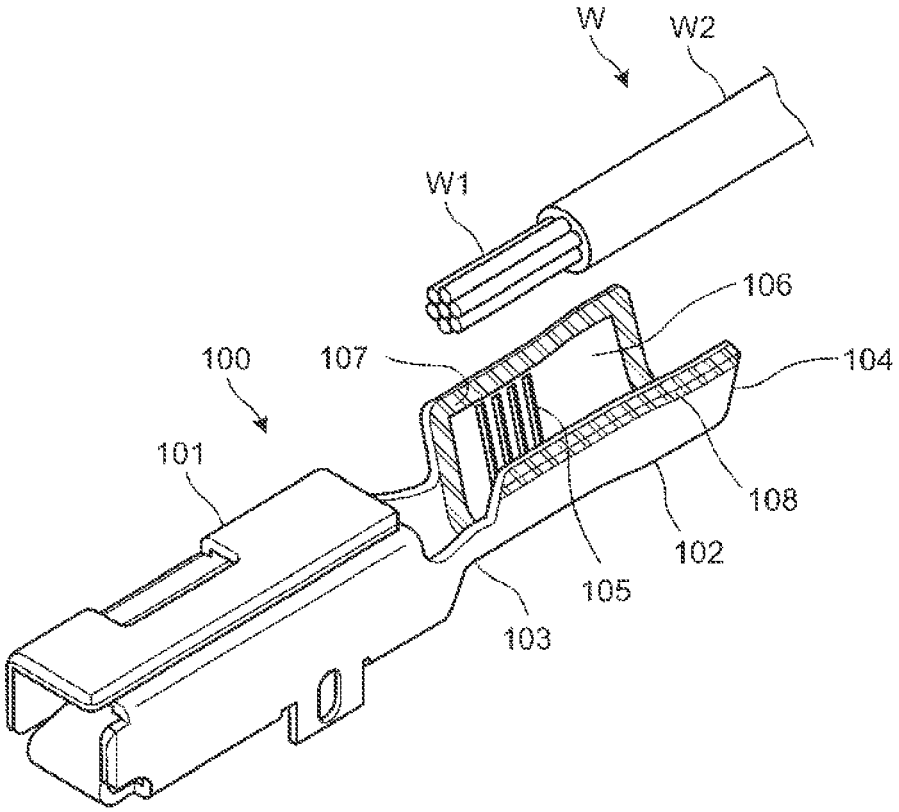
FIG.15 PRIOR ART
FIG. 15 is an exploded perspective view illustrating a conventional wire with a terminal.
Figure 16A:
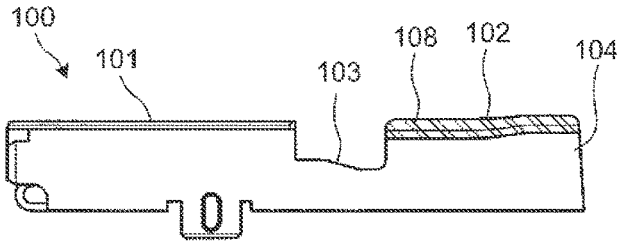
FIG.16A PRIOR ART
FIG. 16A is a side view illustrating the conventional wire with a terminal.
Figure 16B:
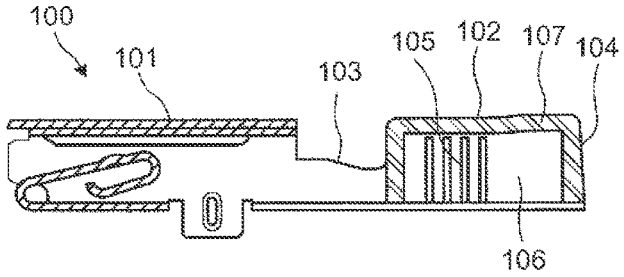
FIG.16B PRIOR ART
FIG. 16B is a sectional view illustrating the conventional wire with a terminal.
Figure 16C:
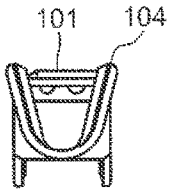
FIG.16C PRIOR ART
FIG. 16C is a side view illustrating the conventional wire with a terminal.
Figure 16D:
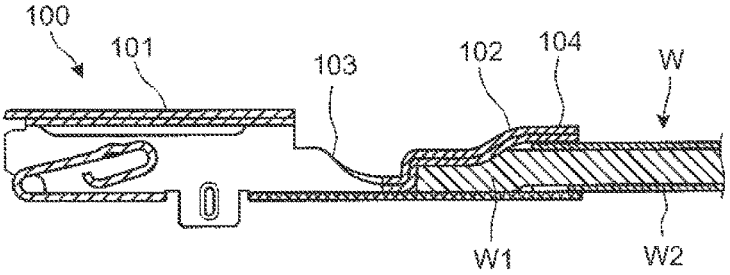
FIG.16D PRIOR ART
FIG. 16D is a sectional view illustrating the conventional wire with a terminal.
Figure 16E:
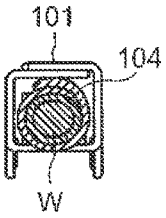
FIG.16E PRIOR ART
FIG. 16E is a sectional view illustrating the conventional wire with a terminal.

Next, a terminal fitting 2C according to a third embodiment will be described in detail with reference to FIGS. 11 to 14. In the state in which a barrel piece 41 is crimped to a wire W by caulking, a small-diameter part 48, which is deformed toward a core W1 of the wire W by caulking, is formed at a front end of the barrel piece 41 of a wire connection part 4 in the terminal fitting 2C as illustrated in FIGS. 11 and 13. The small-diameter part 48 is configured to be in contact with the tip end of the core W1. More specifically, the small-diameter part 48 has a function as a positioning unit to position the wire W in the longitudinal direction by contacting to the tip end of the core W1. In other words, the positioning unit is formed by deforming the small-diameter part 48 at the front end of the barrel piece 41 toward the core W1 by caulking. The small-diameter part 48 is formed anterior to a serration part 42 for positioning the tip end of the core W1. As illustrated in FIG. 13B, the diameter of the small-diameter part 48 is small, so that a water stop part 44 and a front water stop part 45 are crushed and, therefore, the inside of the barrel piece 41 is closed. It should be noted that the small-diameter part 48 is not limited to the one formed at the end of the barrel piece 41. The small-diameter part 48 may be formed by caulking the bottom wall of the barrel piece 41 as illustrated in FIGS. 14A and 14B.

In the manufacturing procedure of the wire with a terminal 1 described above, the water stop material applying process or the water stop material attaching process, the wire set process, and the barrel piece caulking process are sequentially performed in this order as in the first embodiment and the second embodiment. When a crimp device (not illustrated) caulks the barrel piece 41 to crimp a terminal fitting 2A and the wire W in the barrel piece caulking process, the crimp device more strongly caulks the front end of the barrel piece 41 to form the small-diameter part 48. Thereafter, the terminal fittings 2C in a chain are separated, whereby the wire with a terminal 1 in which the terminal fitting 2C is crimped to the terminal of the wire W is manufactured.

According to the above present embodiments, the tip end of the core W1 of the wire W is positioned by the projecting piece 46 or 47 or the small-diameter part 48 formed anterior to the serration part 42. This configuration can prevent the positional deviation of the wire W. Accordingly, the core W1 and the serration part 42 can surely be connected without enhancing the positioning precision of the wire W more than necessary in the crimping operation. Further, the gap between the barrel piece 41 and the wire W is closed by the water stop part 44. The closed gap can prevent water or the like from entering the connection part between the core W1 and the serration part 42, whereby corrosion of the terminal fitting 2 and the core W1 can be prevented. In addition, the projecting piece 46 or 47 or the small-diameter part 48 is deformed by caulking. Accordingly, deformation of the coupling part 5 is not required, whereby the strength of the terminal fitting 2 can be ensured.

As described above, the terminal fitting includes the positioning unit mounted anterior to the serration part for positioning the tip end of the core of the wire. According to the above configuration, the positional deviation of the wire can be prevented. Therefore, the core and the serration part can surely be connected without enhancing the positioning precision of the wire more than necessary in the crimping operation. The gap between the barrel piece and the wire is closed by the water stop part in the terminal fitting. The closed gap can prevent water or the like from entering the connection part between the core and the serration part, whereby corrosion of the terminal fitting and the core can be prevented.

In the terminal fitting, the positioning unit is formed by deforming a projecting piece which projects forward at a circumferential end of the barrel piece or the water stop part, or by deforming a front end of the barrel piece. With this configuration, an operator can caulk the barrel piece while confirming the tip end of the core during the crimping operation, whereby the positional deviation of the wire can more surely be prevented. In addition, the strength of the terminal fitting can be ensured without entailing deterioration in strength of the coupling part, by deforming the front end of the projecting piece or the barrel piece by caulking, not by deforming the coupling part together with the barrel piece as in the conventional terminal fitting.

In the present invention, the position of the tip end of the core is positioned by the positioning unit. Accordingly, the present invention can prevent the positional deviation of the wire, can enhance working efficiency for the crimping operation, and can prevent connection failure between the core and the serration part. According to the present invention, the connection part between the core and the serration part is waterproofed by the water stop part, whereby corrosion of the terminal fitting and the core can be prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

In the above embodiments, a female terminal is illustrated as an example of the terminal fitting 2. However, the terminal fitting according to the present invention is not limited to a female terminal, but may be a male terminal.

The above embodiments describe the method of applying a water stop material by using the water stop material applying device M1, and the method of attaching the water stop sheet 44A by using the water stop material attaching device M2, as the method of forming the water stop part 44. However, it is not limited thereto. For example, a liquid water stop material may be ejected from an ink jet head and applied onto an inner surface of the barrel piece 41, a water stop material may be applied by using a pen-type application tool impregnated with the water stop material on its tip end, or the barrel piece 41 in which the serration part 42 is masked is dipped into a liquid water stop material to apply the water stop material.

The range where the water stop part 44 is formed on the inner surface of the barrel piece 41 may be the entire inner surface of the barrel piece 41 except for the serration part 42, or may be only one of a front side and a back side of the barrel piece 41. The range can appropriately be set.

What is claimed is:

1. A terminal fitting comprising:

an electric contact part connected to a counterpart terminal from front; and a wire connection part connected to a wire at a back of the electric contact part, wherein the wire connection part includes:

a barrel piece which is caulked while covering a tip end of the wire, thereby being crimped to the wire extending in a longitudinal direction of the terminal fitting;

a serration part formed on an inner surface of the barrel piece and connected to a core of the wire; and a water stop part mounted on the inner surface of the barrel piece to close a gap with the wire, and a positioning member mounted anterior to the serration part to position a tip end of the core in the longitudinal direction, the positioning member being mounted to at least one of the barrel piece and the water stop part and extending therefrom in a cantilevered manner.

2. The terminal fitting according to claim 1, wherein the positioning member is a projecting piece projecting forward from a circumferential end of the barrel piece or the water stop part and being deformed toward the core by caulking.

3. A manufacturing method for manufacturing a wire with a terminal by crimping the terminal fitting according to claim 1 to a wire, the method comprising:

applying a liquid water stop material onto an inner surface of the barrel piece to form the water stop part, or attaching a sheet water stop material to the inner surface of the barrel piece to form the water stop part; and deforming the barrel piece into a cylinder by caulking to cover the tip end of the wire as well as to cause the water stop part to be in close contact with the wire.

4. A manufacturing method for manufacturing a wire with a terminal by crimping the terminal fitting according to claim 2 to a wire, the method comprising:

applying a liquid water stop material onto an inner surface of the barrel piece to form the water stop part, or attaching a sheet water stop material to the inner surface of the barrel piece to form the water stop part; and deforming the barrel piece into a cylinder by caulking to cover the tip end of the wire as well as to cause the water stop part to be in close contact with the wire.

5. The terminal fitting according to claim 1, wherein the positioning member is formed such that a front end of the barrel piece is deformed toward the core by caulking.

6. The terminal fitting according to claim 1, wherein the positioning member is mounted to the water stop part, and in the longitudinal direction, the positioning member is cantilevered from the water stop part such that a free end of the positioning member is closer to the electric contact part than both of the water stop part and the barrel piece.

7. The terminal fitting according to claim 1, wherein the positioning member is cantilevered from a first position of the at least one of the barrel piece and the water stop part to a second position, wherein the first position is arranged before the tip end of the core in the longitudinal direction extending from the wire connection part to the electric contact part, and wherein the second position is arranged after the tip end of the core in the longitudinal direction extending from the wire connection part to the electric contact part.

8. The terminal fitting according to claim 7, wherein the second position is arranged in a portion of the water stop part abutting a projection of the barrel piece, the projection extending from a bottom of the barrel piece in a direction substantially perpendicular to the longitudinal direction.

* * * * *